US009249724B2

(12) United States Patent
Gutzer

(10) Patent No.: US 9,249,724 B2
(45) Date of Patent: Feb. 2, 2016

(54) DEVICE FOR CHANGING A COMPRESSION RATIO OF A RECIPROCATING PISTON INTERNAL COMBUSTION ENGINE

(71) Applicant: Bayerische Motoren Werke Aktiengesellschaft, Munich (DE)

(72) Inventor: Ulrich Gutzer, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 12 days.

(21) Appl. No.: 14/022,906

(22) Filed: Sep. 10, 2013

(65) Prior Publication Data

US 2014/0096748 A1 Apr. 10, 2014

Related U.S. Application Data

(63) Continuation of application No. PCT/EP2012/001273, filed on Mar. 22, 2012.

(30) Foreign Application Priority Data

Apr. 19, 2011 (DE) ..... 10 2011 018 166

(51) Int. Cl.
*F02B 75/04* (2006.01)
*F02D 15/02* (2006.01)

(52) U.S. Cl.
CPC ..... *F02B 75/047* (2013.01); *F02B 75/048* (2013.01); *F02D 15/02* (2013.01)

(58) Field of Classification Search
CPC ..... F02B 41/04; F02B 75/048
USPC ..... 123/48 B, 48 R, 48 A–48 AA
See application file for complete search history.

(56) References Cited

U.S. PATENT DOCUMENTS 1,115,477 A 5/1871 Ide
3,686,972 A 8/1972 McWhorter (Continued)

FOREIGN PATENT DOCUMENTS

DE 181913 C 3/1907
DE 445539 C 6/1927

(Continued)

OTHER PUBLICATIONS

German Search Report with English translation dated Mar. 2, 2012 (ten (10) pages).

(Continued)

*Primary Examiner* — Lindsay Low
*Assistant Examiner* — Kevin Lathers
(74) *Attorney, Agent, or Firm* — Crowell & Moring LLP

(57) ABSTRACT

A device for changing a compression ratio of an internal combustion engine is provided. The engine has a crank drive with a crankshaft with at least one crank pin, mounted in a rotationally movable fashion, connected to a connecting rod and a piston arranged in a cylinder of the internal combustion engine. In order to convert rotational movement of the crankshaft into a bidirectional movement of the piston with a defined stroke height, a rotationally movable, externally toothed eccentric for changing the piston stroke height is arranged between the crank pin and an eyelet on the connecting rod. In order to rotate the eccentric, an externally toothed first gearwheel is axially connected in a rotationally fixed fashion to a second gearwheel via a shaft arranged parallel to the crankshaft which is arranged in a meshing fashion on a third gearwheel which can be rotated by an actuating element.

9 Claims, 4 Drawing Sheets

(56) References Cited

U.S. PATENT DOCUMENTS

| | | | | |
|---|---|---|---|---|
| 5,170,757 | A | 12/1992 | Gamache | |
| 7,293,542 | B2 * | 11/2007 | Ozdamar | 123/197.1 |
| 8,662,032 | B2 * | 3/2014 | Pohjalainen | 123/78 A |
| 2006/0053964 | A1 | 3/2006 | Venettozzi | |
| 2011/0036334 | A1 | 2/2011 | De Gooijer | |

FOREIGN PATENT DOCUMENTS

| | | | | |
|---|---|---|---|---|
| DE | 583428 | C | 9/1933 | |
| DE | 10 2006 015 887 | A1 | 10/2007 | |
| DE | 10 2008 046 821 | A1 | 4/2010 | |
| EP | 0 184 042 | A2 | 6/1986 | |
| EP | 2 025 893 | A1 | 2/2009 | |
| FR | 986 605 | A | 8/1951 | |
| WO | WO 2006/004612 | A2 | 1/2006 | |
| WO | WO 2009/100759 | A1 | 8/2009 | |
| WO | WO2009100759 | * | 8/2009 | F02B 41/04 |

OTHER PUBLICATIONS

International Search Report dated Sep. 26, 2012 with English translation (seven (7) pages).

German language Writted Opinion (PCT/ISA/237) dated Sep. 26, 2012 (six (6) pages).

* cited by examiner

DEVICE FOR CHANGING A COMPRESSION RATIO OF A RECIPROCATING PISTON INTERNAL COMBUSTION ENGINE

CROSS REFERENCE TO RELATED APPLICATIONS

This application is a continuation of PCT International Application No. PCT/EP2012/001273, filed Mar. 22, 2012, which claims priority under 35 U.S.C. §119 from German Patent Application No. DE 10 2011 018 166.0 filed Apr. 19, 2011, the entire disclosures of which are expressly incorporated by reference herein.

BACKGROUND AND SUMMARY OF THE INVENTION

The invention relates to a device for altering the compression ratio of an internal combustion engine.

A variable compression ratio unlocks consumption- and performance potential by adapting the same to the changing load on the internal combustion engine, wherein said potential remains untapped if there is a constant compression ratio.

By way of example, such an internal combustion engine is known from U.S. Pat. No. 1,115,477.

Also known is the use of an eccentric bearing shell in the large connecting rod eye to establish a variable compression ratio, wherein said bearing shell rotates in the same direction at half the rotation speed of the crankshaft. The compression ratio can then be adjusted by shifting the phase angle of the bearing shell.

On the website of the Gomecsys company, www.gomecsys.com, a device in this class is known which serves the purpose of altering the compression ratio of a four cylinder reciprocating internal combustion engine having a crankshaft drive. The crankshaft drive has a crankshaft which bears crankpins which are able to rotate on both ends and which each have a functional connection to one connecting rod and one piston arranged in a cylinder of the reciprocating internal combustion engine, said piston able to execute a sliding movement. In this way, the rotational movement of the crankshaft is converted into a bidirectional translational movement of the pistons in the cylinders with a defined stroke height. One eccentric is arranged between each crankpin and connecting rod eye of the connecting rods, said eccentric being able to rotate and having external gearing. By use of the eccentric, it is possible to adjust the height of the piston stroke and/or to alter the compression ratio. In this case, one first gear with outer toothing is included per eccentric, for the purpose of rotating the same, and is connected axially in a torque-proof manner to a second gear via a shaft which is oriented parallel to the crankshaft. This gear interacts with a gear having inner toothing, the same being rotated by a worm gear. As such, the compression ratio of the reciprocating internal combustion engine can be altered or adjusted by the rotation of the gear having inner toothing.

This design has the disadvantage of a substantial weakening of the load-bearing structure of the crankshaft, particularly in the crankshaft main bearing, resulting from the synchronization gearing which is required for the phase angle-/compression shift, from the crankcase to the eccentric bearing shell. This leads to a reduction of the increased power performance of the internal combustion engine which can be achieved with the compression ratio shift, and to an increase in friction loss resulting from the increased bearing diameter.

As a result, a substantial amount of the potential which can be achieved by the variable compression ratio of the internal combustion engine is wasted.

The problem addressed by the present invention is that of avoiding the disadvantages named above.

According to the invention, a device (a synchronization gearing) is provided for the purpose of altering the compression ratio of a reciprocating internal combustion engine, which acts externally around the load-bearing crankshaft structures, and simultaneously ensures the required speed ratio. In this case, the gears (the third and fourth gears), the same being rotatably mounted in the crankcase, only move when the compression ratio is shifted, but not constantly as a result of the rotation of the crankshaft.

A device according to the present invention may include a crankshaft drive with a crankshaft with at least one crankpin mounted rotatably on both ends thereof, said crankpin having a functional connection with a connecting rod and a piston arranged in a cylinder of the reciprocating internal combustion engine in a manner allowing sliding movement, for the purpose of converting a rotational movement of the crankshaft into a bidirectional, translational movement of the piston with a defined stroke height, wherein a rotating eccentric with outer teeth is arranged between the crankpin and a connecting rod eye of the connecting rod, for the purpose of altering the stroke height of the piston, wherein a first gear with outer teeth is included for the purpose of rotating the eccentric, and is connected in a torque-proof manner axially to a second gear via a shaft arranged parallel to the crankshaft, said first gear is arranged on and intermeshing with a third gear which can be rotated by a control element, and the shaft is arranged parallel and radially distanced from the crankshaft suited for a single-cylinder reciprocating internal combustion engine.

A particularly preferred embodiment includes a fourth gear which is connected in a torque-proof manner to the third gear, wherein the fourth gear has a larger outer diameter than the third gear, and the fourth gear can be rotated by the control element.

An embodiment in which the crankshaft has a second crankpin which has a functional connection with a second connecting rod and a second piston, the same being arranged in a second cylinder of the reciprocating internal combustion engine in a manner allowing a sliding movement, for the purpose of converting the rotational movement of the crankshaft into a bidirectional, translational movement of the second piston with a defined stroke height, wherein a rotating second eccentric with outer teeth is arranged between the second crankpin and a connecting rod eye of the second connecting rod, for the purpose of altering the stroke height of the second piston, having a fifth gear with outer teeth is included for the purpose of rotating the second eccentric, and is connected in a torque-proof manner axially to a sixth gear via a second shaft arranged parallel to the crankshaft, the sixth gear having a functional connection with the eccentric having an outer toothing, makes it possible to use the device according to the invention in a multi-cylinder inline reciprocating internal combustion engine.

A further embodiment in which the second shaft is arranged in an axial borehole of the crankshaft, coaxially to the crankshaft has a particularly compact construction.

Embodiments of the present invention in which the third or the fourth gear can be rotated by the control element via a seventh gear or a gear rack, or a worm gear or a push actuator are particularly preferred.

Another embodiment in which an intermediate gear is arranged between the first gear and the fifth gear enables direct application of the fifth gear.

Other objects, advantages and novel features of the present invention will become apparent from the following detailed description of one or more preferred embodiments when considered in conjunction with the accompanying drawings.

DETAILED DESCRIPTION OF THE DRAWINGS

In the following, the same reference numbers are used for the same components in the FIGS. 1 to 4.

Figure 1:
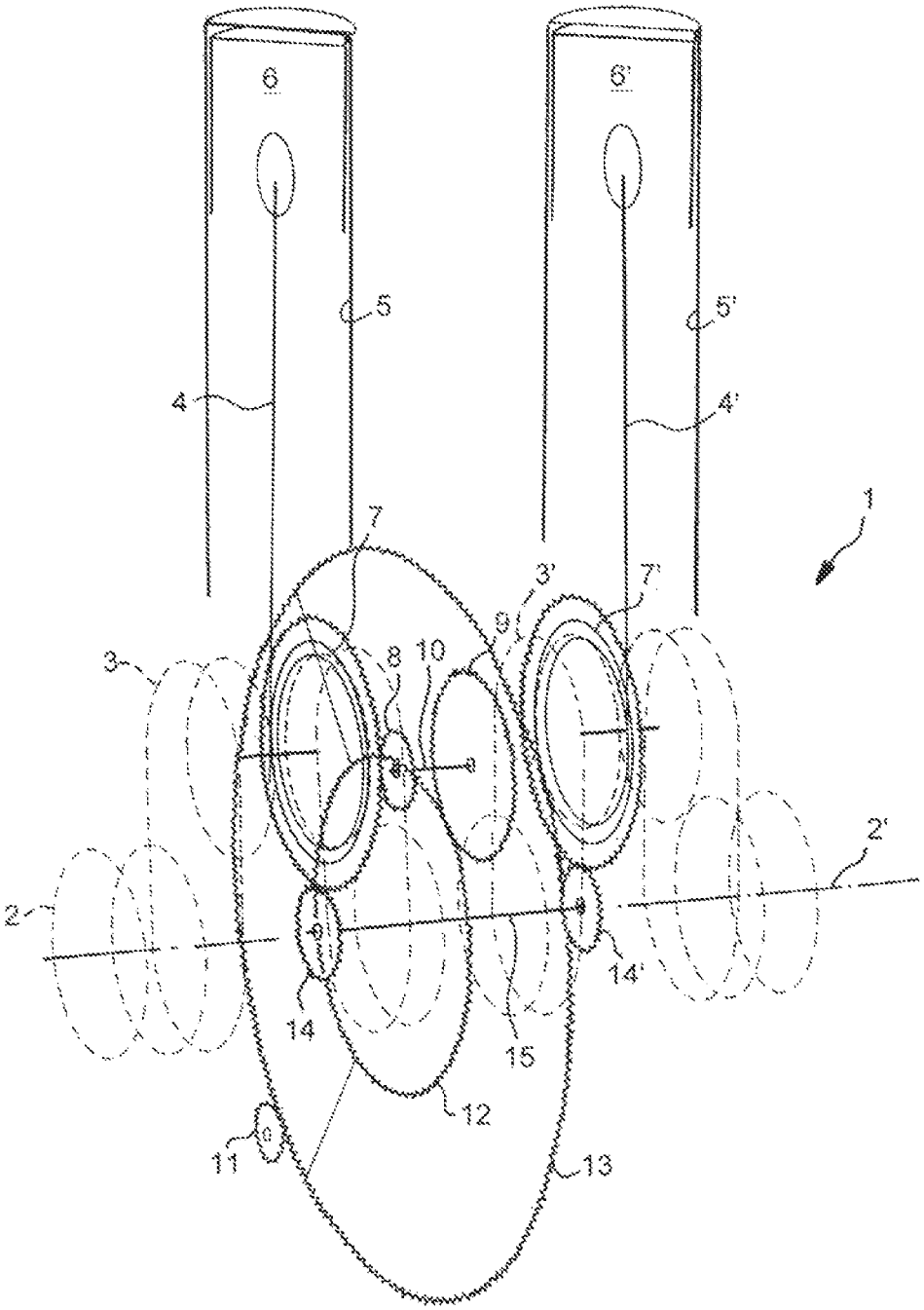
FIG. 1 shows a schematic view of a device according to an embodiment of the present invention for altering a compression ratio for a reciprocating internal combustion engine having two cylinders.

FIG. 1 shows a schematic view of an embodiment of a device according to the invention for altering a compression ratio for a reciprocating internal combustion engine having two cylinders.

The ratio of the entire space inside of a cylinder of an internal combustion engine, prior to compression, to the remaining space following the compression, is termed the compression ratio $\epsilon$.

$$\varepsilon = \frac{V_H + V_K}{V_K}$$

where $V_H$=stroke volume (stroke height*piston surface area)

$V_K$=compression volume

The reciprocating internal combustion engine has a crankshaft drive 1 having a crankshaft 2, the same illustrated with a dashed line and having two crankpins 3, 3' which are mounted and able to rotate on both ends, and which each have a functional connection to one connecting rod 4, 4' and one piston 6, 6', the same arranged in a cylinder 5, 5' of the reciprocating internal combustion engine and able to slide in two directions. A crankshaft axis is indicated by the number 2'. This part of the device serves the purpose of converting a rotational movement of the crankshaft 2 into a bidirectional, translational movement of the piston 6, 6' with a defined stroke height. One rotating eccentric 7, 7' with an outer toothing is arranged between each crankpin 3, 3' and connecting rod eye (not indicated by reference numbers) of the connecting rods 4, 4' for the purpose of altering the stroke height of the pistons 6, 6'. For the purpose of rotating the eccentric 7, a first gear 8 with outer toothing is included which is connected axially in a torque-proof manner to a second gear via a shaft 10 arranged parallel to the crankshaft 2. In this embodiment, the second gear 9 is connected in a torque-proof manner to a fourth gear 13 via the third gear 12, said fourth gear 13 having a larger outer diameter than the revolving second gear 9. The fourth gear 13 in this embodiment can be shifted rotationally via a control element 11. The third and fourth gear 12, 13 are mounted in a crankcase of the reciprocating internal combustion engine in a manner allowing rotation. As a result of the fourth gear 13 being shifted, as mentioned above, the eccentric 7 rotates and therefore alters the compression ratio of the internal combustion engine. According to the invention, the shaft 10 is arranged parallel and radially outward from the crankshaft 2.

This fundamental shifting mechanism and/or this device for altering the compression ratio of the reciprocating internal combustion engine can be used for a reciprocating internal combustion engine having a cylinder.

However, because in the present embodiment, a reciprocating internal combustion engine having two cylinders is illustrated, a fifth gear 14 engages with the outer toothing of the eccentric 7, and is connected in a torque-proof manner to a sixth gear 14' via a second shaft 15 which is arranged parallel to the crankshaft axis 2', wherein said sixth gear 14' transmits the shifting movement of the fifth gear 14 to an outer toothing of the second eccentric 7'.

In a further embodiment, the fourth gear 13 can be dispensed with, and the control element 11 acts directly on the third gear 12.

In the embodiment in FIG. 1, the second shaft 14 is arranged in an axial bore hole of the crankshaft 2 coaxially to the crankshaft 2, thereby enabling a very space-saving construction. In further embodiments, the third or the fourth gear 12, 13 can be rotated by the control element 11 via a seventh gear or a gear rack or a worm gear or a push actuator.

Figure 2:
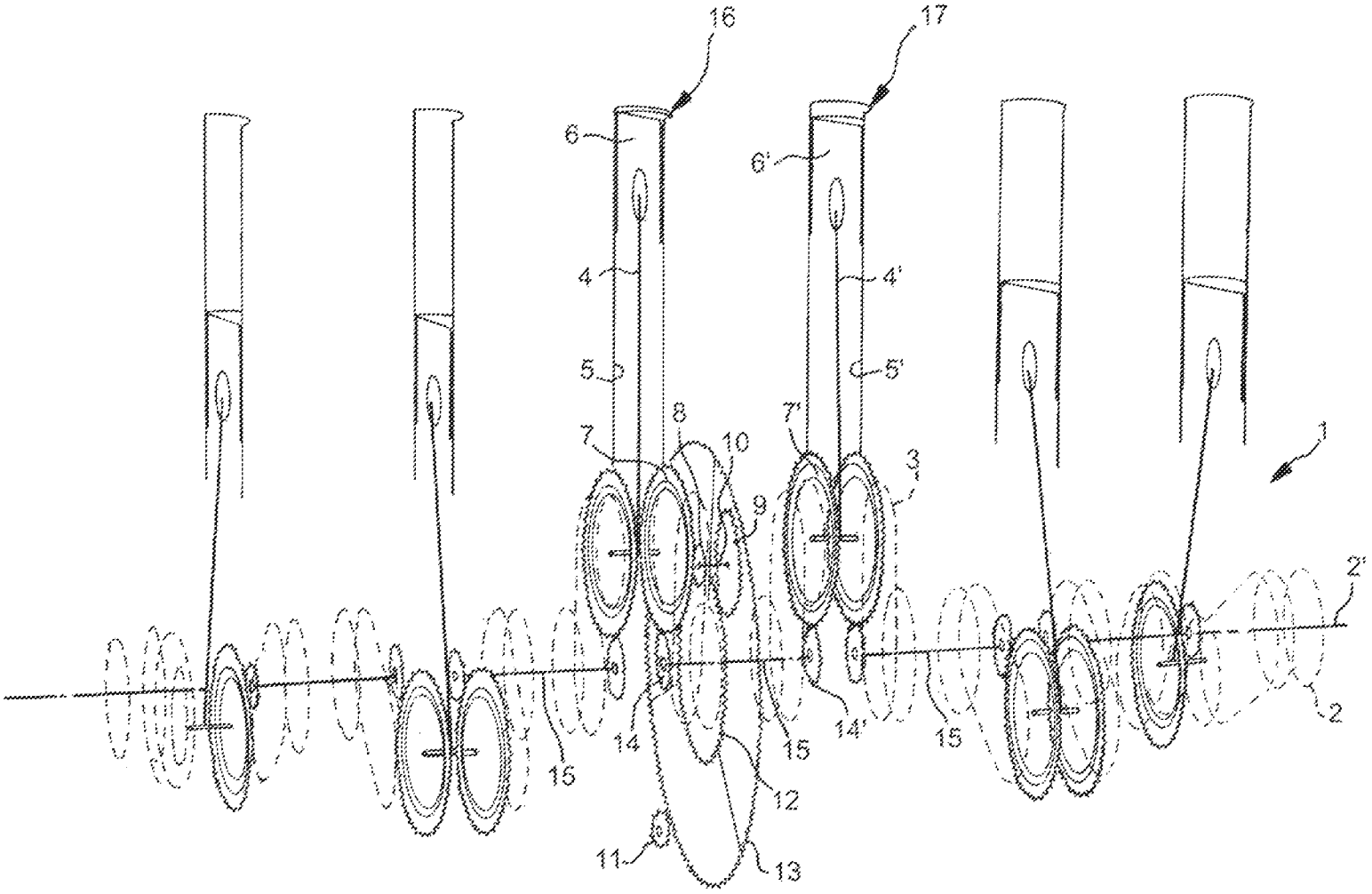
FIG. 2 shows a schematic view of a second device according to an embodiment of the present invention for altering the compression ratio of a reciprocating internal combustion engine having six cylinders.

FIG. 2 shows another embodiment of a device for altering the compression ratio of a reciprocating internal combustion engine having six cylinders. The two central cylinders again display the same kinematics as in FIG. 1, but on both sides of the two central cylinders and arranged adjacent thereto are two additional cylinders, not identified with reference numbers, having the same crankshaft drive, and also having a fixed drive to a second shaft 15, for the purpose of altering the compression ratio of the four additional cylinders, the same not indicated by reference numbers.

In the embodiment illustrated in FIG. 2, the cylinder 6 of the reciprocating internal combustion engine has a high compression 16, and the cylinder 6' has a low compression 17.

Figure 3:
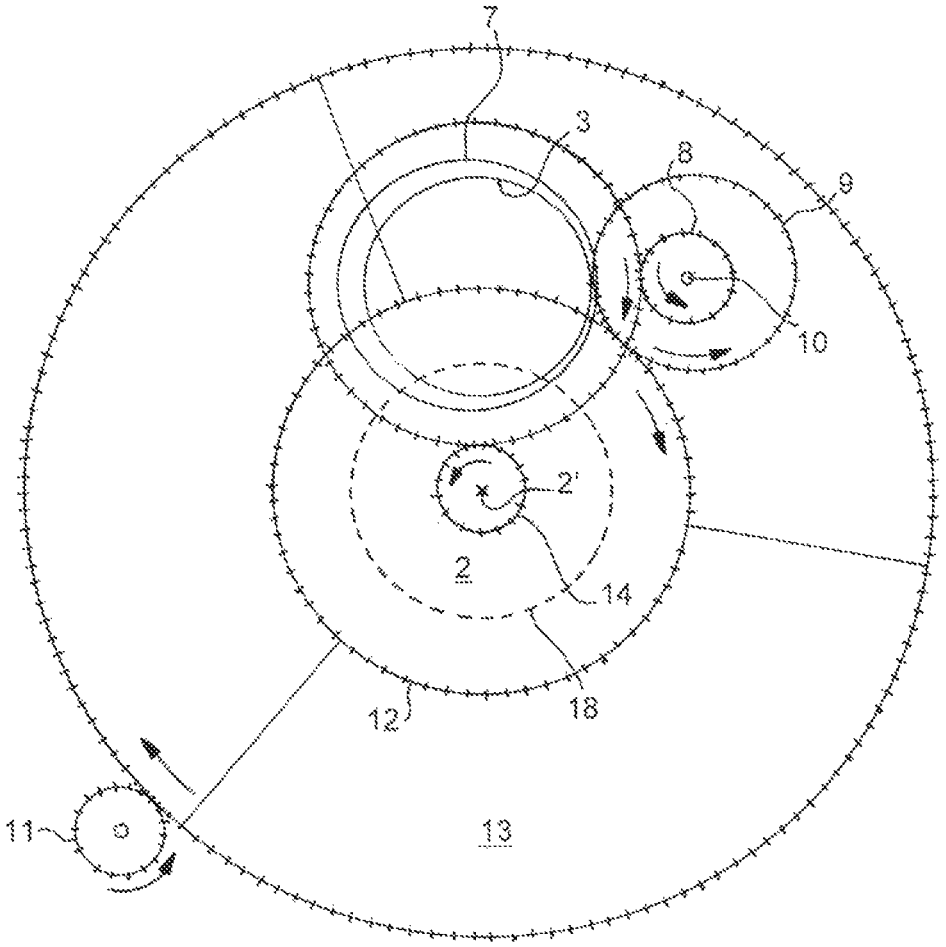
FIG. 3 shows a schematic end-face view of a device according to an embodiment of the present invention for altering the compression ratio of a reciprocating internal combustion engine.

FIG. 3 shows a schematic end-face view of the device according to an embodiment of the invention for altering the compression ratio of a reciprocating internal combustion engine, as can be used in FIGS. 1 and 2. In this functioning practical embodiment, the gears have the following tooth counts:

eccentric 7: 55 teeth
first gear 8: 15 teeth
second gear 9: 36 teeth
third gear 12: 66 teeth
fourth gear 13: 148 teeth The directions in which the individual gears rotate for a higher compression ratio is schematically indicated by arrows. The cylinder orientation in this case is vertical, meaning upwards towards the crankpin, and/or the eccentric 3.

Figure 4:
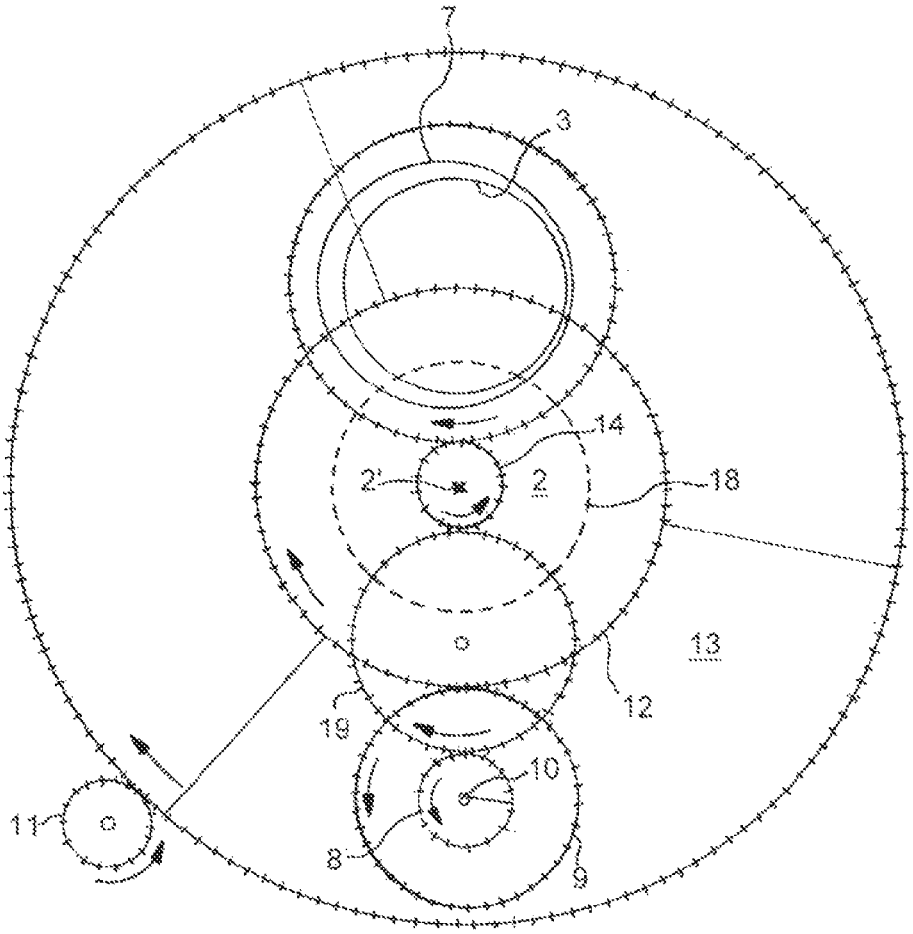
FIG. 4 shows a schematic end-face view of a device according to another embodiment of the present invention for altering the compression ratio of a reciprocating internal combustion engine.

FIG. 4 shows a schematic end-face view of a further embodiment of a device according to the invention for altering the compression ratio of a reciprocating internal combustion engine. That which was described for FIG. 3 applies substantially here as well, with the exception that in this further embodiment, an intermediate gear 19 is arranged between the first gear 8 and the fifth gear 14, and consists of only one single gear in this embodiment.

The directions in which the individual gears rotate to effect a greater compression ratio are again schematically indicated by arrows.

In other words, and in summary: A synchronization gearing is hereby suggested which acts externally around the load-bearing crankshaft structures, and ensures the required speed ratio. In this case, the gears 12, 13 mounted in the crankcase only move during the shifting of the compression ratio, and not constantly as a result of the rotation of the crankshaft 2. The synchronization is realized between two cranks of the crankshaft, through the center of the main bearing pin of the crankshaft 2, because the latter is typically hollow as such, because hardly any load is transmitted at this point on the crankshaft.

As such, a system is suggested which does not produce any frictional disadvantages resulting from a larger crankshaft diameter.

If the journal bearings inside and outside on the eccentric bearing shell are sized appropriately (the width×diameter$^3$ are approximately the same inside and outside), these rotate independently at half of the rotation speed of the crankshaft, such that on average no drive energy is accumulated. The sum of the friction of these two journal bearings connected in series for each crankpin can even be smaller than that of a conventional crankpin journal bearing in the prior art, particularly if the sum of the two bearing clearances can remain larger than that of the original, single journal bearing (the friction component is proportional to the fourth power of the relative rotation divided by the bearing clearance).

Because the setting of the control element 11 on the crankcase discretely reflects the selected compression ratio (in contrast to known systems which only have one stop, and the system can shift itself while under operating loads), if there is a valve stroke adjusting device (e.g. the BMW valvetronic), there can be a mechanical coupling of the valve stroke or the phase angle and the compression ratio. By way of example, one example of the combination of a variable compression ratio and a variable valve control is known from the German patent publication DE 10 2006 015 887 A1. Because, in general, it is possible to combine low compression with large valve strokes, and vice-versa, under high loads, it is therefore possible to minimize valve clearance in the piston, which opens up the possibility of further thermodynamic fuel consumption advantages resulting from a more favorable shape of the combustion chamber.

As such, the invention opens up the possibility for consumption advantages compared to conventional reciprocating internal combustion engines, using technology that is adapted to existing available space, with very minimal energy for the adjustments. In addition, the invention achieves a maximum utilization of the potential of the variable compression ratio by direct, continuous, and rapid adjustability.

LIST OF REFERENCE NUMBERS

1. crankshaft drive
2. crankshaft
2' crankshaft axis
3. crankpin
3' second crankpin
4. connecting rod
4' second connecting rod
5. cylinder
5' second cylinder
6. piston
6' second piston
7. eccentric
7' second eccentric
8. first gear
9. second gear
10. shaft
11. control element
12. third gear
13. fourth gear
14 fifth gear
14' sixth gear
15. second shaft
16. high compression
17. low compression
18. crankshaft main bearing
19. intermediate gear The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A device for altering a compression ratio of a reciprocating internal combustion engine, comprising:

a crankshaft drive with a crankshaft with at least one crankpin mounted rotatably on both ends thereof;

a piston arranged in a cylinder of the reciprocating internal combustion engine;

a connecting rod having a functional connection with said crankpin and said piston in a manner allowing conversion a rotational movement of the crankshaft into a bidirectional, translational movement of the piston with a defined stroke height;

a rotating eccentric with outer teeth arranged between the crankpin and a connecting rod eye of the connecting rod such that rotation of the rotating eccentric alters the stroke height of the piston;

a first gear with outer teeth arranged to rotate the rotating eccentric, the outer teeth of the first gear meshing with outer teeth of the rotating eccentric;

a second gear, said first gear being connected in a torque-proof manner axially to the second gear via a shaft arranged parallel to the crankshaft; and a third gear rotatable by a control element, said second gear being arranged on and intermeshing with the third gear, wherein the shaft is arranged parallel and radially distanced from the crankshaft.

2. The compression ratio altering device according to claim 1, further comprising:

a fourth gear connected in a torque-proof manner to the third gear, wherein the fourth gear has a larger outer diameter than the third gear, and the fourth gear is rotatable by the control element.

3. The compression ratio altering device according to claim 2, further comprising:

a second crankpin of the crankshaft, the second crankpin having a functional connection with a second connecting rod and a second piston, wherein the second connecting rod and second piston are arranged in a second cylinder of the reciprocating internal combustion engine;

a second rotating eccentric with outer teeth arranged between the second crankpin and a connecting rod eye of the second connecting rod such that rotation of the second rotating eccentric alters a stroke height of the second piston;

a fifth gear with outer teeth; and a sixth gear having a functional connection with the second eccentric having an outer toothing, said fifth gear being connected in a torque-proof manner axially to the sixth gear via a second shaft arranged parallel to the crankshaft such that rotation of the fifth gear rotates the second eccentric.

4. The compression ratio altering device according to claim 3, wherein the second shaft is arranged coaxially in an axial borehole of the crankshaft.

5. The compression ratio altering device according to claim 4, further comprising:

an intermediate gear arranged between the first gear and the fifth gear.

6. The compression ratio altering device according to claim 4, wherein the third or the fourth gear is rotatable by the control element via a seventh gear, a gear rack, a worm gear or a push actuator.

7. The compression ratio altering device according to claim 3, wherein the third or the fourth gear is rotatable by the control element via a seventh gear, a gear rack, a worm gear or a push actuator.

8. The compression ratio altering device according to claim 7, further comprising:

an intermediate gear arranged between the first gear and the fifth gear.

9. The compression ratio altering device according to claim 3, further comprising:

an intermediate gear arranged between the first gear and the fifth gear.

* * * * *